US008070153B2

(12) United States Patent
Kang

(10) Patent No.: US 8,070,153 B2
(45) Date of Patent: Dec. 6, 2011

(54) IMAGE FORMING APPARATUS WITH CASSETTE AND PAPER SENSING DEVICE

(75) Inventor: Il Kwon Kang, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 744 days.

(21) Appl. No.: 12/142,170

(22) Filed: Jun. 19, 2008

(65) Prior Publication Data

US 2009/0129790 A1 May 21, 2009

(30) Foreign Application Priority Data

Nov. 20, 2007 (KR) ..... 10-2007-0118665

(51) Int. Cl.
*B65H 1/22* (2006.01)

(52) U.S. Cl. ..... 271/164; 271/145; 399/23

(58) Field of Classification Search ..... 271/164, 271/162, 145, 152, 25, 31, 38, 130; 399/393, 399/23

See application file for complete search history.

(56) References Cited

U.S. PATENT DOCUMENTS 4,196,898 A * 4/1980 Misawa et al. ..... 271/9.08
4,449,705 A * 5/1984 Shibuya et al. ..... 271/9.09
5,897,112 A * 4/1999 Kwag ..... 271/38
6,152,631 A * 11/2000 Park ..... 400/708
6,292,636 B1 * 9/2001 Kwon ..... 399/16
6,659,449 B2 * 12/2003 Kim ..... 271/117
2010/0074637 A1 * 3/2010 Shiraishi ..... 399/23
2010/0090394 A1 * 4/2010 You ..... 271/162

FOREIGN PATENT DOCUMENTS

JP 2003-226444 8/2003

OTHER PUBLICATIONS

English language abstract of JP 2003-226444, published Aug. 12, 2003.

* cited by examiner

*Primary Examiner* — Jeremy R Severson
(74) *Attorney, Agent, or Firm* — Staas & Halsey LLP

(57) ABSTRACT

An image forming apparatus and a printing medium feeding unit thereof are disclosed. The image forming apparatus includes a main body, a cassette removably mounted in the main body to load a printing medium therein, and a sensing unit provided in the main body to sense whether the cassette is mounted in the main body and whether the printing medium is in the cassette. The sensing unit includes a first actuator mounted in the main body to sense whether the printing medium is in the cassette, a second actuator mounted in the main body to sense whether the cassette is mounted in the main body, and a sensor having a sensing part to sense operation of the first actuator and the second actuator. Accordingly, the image forming apparatus can sense whether the cassette is properly mounted in the main body and whether the printing medium is in the cassette, with a simple constitution while minimizing the number of sensors.

21 Claims, 14 Drawing Sheets

Prior Art

Prior Art

Prior Art

IMAGE FORMING APPARATUS WITH CASSETTE AND PAPER SENSING DEVICE

CROSS-REFERENCE TO RELATED APPLICATION

This application claims the benefit of Korean Patent Application No. 2007-0118665, filed on Nov. 20, 2007 in the Korean Intellectual Property Office, the disclosure of which is incorporated herein by reference.

BACKGROUND OF THE INVENTION

1. Field of the Invention

The present invention relates to an image forming apparatus, and more particularly, to an image forming apparatus capable of determining whether the printing medium cassette is properly mounted in the image forming apparatus and whether the printing medium is present in the cassette.

2. Description of the Related Art

An image forming apparatus refers to an apparatus that prints an image on a printing medium according to an image signal. An image forming apparatus may generally be classified as a printer, a copying machine, a fax machine, a multifunction printer, which has multiple functions of printing, scanning, copying and faxing, or the like. In order to supply a printing medium (Hereinafter, referred to as "paper" for convenience. However, a printing medium is not limited to paper), an image forming apparatus comprises a paper feeding unit. A paper feeding unit generally includes a paper sensing device to sense the presence of the paper.

FIGS. 1*a* to 1*c* are views showing a conventional paper feeding unit having a paper sensing device. As shown in FIGS. 1*a* and 1*b*, a conventional paper feeding unit 1 includes a cassette 2 having a paper loading plate 2*a*, and a paper sensing device 3 to sense whether paper is present on the paper loading plate 2*a*.

The paper sensing device 3 includes an actuator 4, a sensor 5 and an operation hole 6. The actuator 4 has a pivot shaft 4*a*, and an operation arm 4*b* and a sensing arm 4*c*, which are connected to the pivot shaft 4*a*. The operation arm 4*b* extends toward the paper loading plate 2*a*, and the sensing arm 4*c* extends toward the sensor 5.

The operation arm 4*b* is provided with a paper contact part 7 at an end portion thereof, which contacts with paper P loaded on the paper loading plate 2*a*. The operation hole 6 is formed on the paper loading plate 2*a*, so as to receive the paper contact part 7 of the operation arm 4*b*. When no paper is on the paper loading plate 2*a*, the paper contact part 7 of the operation arm 4*b* is received in the operation hole 6.

When the paper P is on the paper loading plate 2*a*, as shown in FIG. 1*a*, the paper P interferes with the contact part 7, and accordingly the actuator 4 is pivoted upward, so that the sensing arm 4*c* is positioned away from the sensing region of the sensor 5. A control unit of the image forming apparatus determines that the paper is on the paper loading plate 2*a*, and performs printing operation according to a print command.

On the other hand, when no paper is on the paper loading plate 2*a*, as shown in FIG. 1*b*, the paper contact part 7 of the operation arm 4*b* is received in the operation hole 6, and an end portion of the sensing arm 4*c* is positioned in the sensing region of the sensor 5. If the sensor 5 senses the sensing arm 4*c*, the control unit of the image forming apparatus determines that no paper is on the paper loading plate 2*a*.

However, in the above conventional paper feeding unit, even when the cassette is not properly mounted in a main body, printing operation may be carried out, which may create a problem of improper paper supply or paper jam. For instance, as shown in FIG. 1*c*, even when a user inadvertently did not push the cassette 2 all the way in the main body into the proper cassette mounting position, the operation arm 4*b* is interfered with by the paper P loaded on the paper loading plate 2*a*, and accordingly the sensing arm 4*c* may be positioned away from the sensing region of the sensor 5. In such a case, notwithstanding the abnormal circumstances in which paper supply cannot be achieved correctly, the control unit of the image forming apparatus may determine that the apparatus is in a state capable of performing normal printing operation, and may attempt to perform a printing operation. Accordingly, a printing error may occur.

This problem may be solved by mounting an additional sensor capable of sensing proper mounting of the cassette. However, the installation of the additional sensor to the paper sensing device may make the internal structure of the image forming apparatus complicated, and may increase the manufacturing costs due to the increase in the number of components, thereby rendering the resulting product less competitive.

In addition, according to a recent trend of compactness of the apparatus, the main body may be formed smaller than the cassette. Typically, when mounting the cassette, a user puts the cassette in the main body until the front surface of the cassette is positioned on the same plane as the front surface of the main body. However, in a case where the main body has a smaller form factor than the cassette, though the cassette is perfectly mounted in the main body, a part of the cassette may protrude from the main body. Thus, a user cannot easily confirm visually whether the cassette is properly mounted in the main body, and thus is more likely to make the mistake of incorrectly mounting the cassette. In this regard, due to a current trend of compactness of the image forming apparatus, the impetus for providing a device capable of preventing a printing error by sensing whether the cassette is properly mounted may be especially high.

SUMMARY OF THE INVENTION

Therefore, it is an aspect of the invention to provide an image forming apparatus and a printing medium feeding unit thereof capable of sensing whether a cassette is properly mounted in a main body and whether a printing medium is in the cassette, with a simple constitution while minimizing the number of sensors.

Additional aspects and/or advantages of the invention will be set forth in part in the description which follows and, in part, will be obvious from the description.

In accordance with an aspect of the invention, there is provided an image forming apparatus comprising: a main body having housed therein an image forming unit; a cassette removably mountable in the main body to hold printing medium therein; and a sensing unit provided in the main body, the sensing unit including a sensor arranged to sense an occurrence of at least one of a first abnormal condition and a second abnormal condition, the first abnormal condition being the cassette not being properly mounted in the main body, the second abnormal condition being the printing medium being absent in the cassette, and the sensor providing an indication of a normal operational condition, under which neither of the first abnormal condition and the second abnormal condition exists.

The sensing unit may include: a first actuator mounted in the main body, the first actuator being configured to operate in relation to a presence of the printing medium in the cassette; and a second actuator mounted in the main body, the second actuator being configured to operate in relation to a location of the cassette in the main body; the sensor having a sensing part to sense operational states of the first actuator and the second actuator.

The first actuator may include a first pivot shaft, a first operation arm extending from a first end of the first pivot shaft toward the cassette, and a first sensing arm extending from a second end, opposite the first end, of the first pivot shaft toward the sensing part, the first operation arm being configured to contact, and to move in relation to an amount of, the printing medium held in the cassette to cause the first pivot shaft to rotate, which in turn causes the first sensing arm to move into and out of a range of detection of the sensing part of the sensor.

The second actuator may include a second pivot shaft, a second operation arm extending from a first end of the second pivot shaft toward a position within the main body capable of interfering with the cassette, and a second sensing arm extending from a second end, opposite the first end, of the second pivot shaft toward the sensing part, the second operation arm being configured to interfere with at least a portion of the cassette to move in relation to the location of the cassette in the main body to cause the second pivot shaft to rotate, which in turn causes the second sensing arm to move into and out of the range of detection of the sensing part of the sensor.

When no external force is applied to the first actuator, at least a part of the first sensing arm may be sensed by the sensing part of the sensor, and when no external force is applied to the second actuator, at least a part of the second sensing arm may be sensed by the sensing part of the sensor.

The sensor may provide the indication of the normal operational condition only when both the first sensing arm and the second sensing arm are positioned away from the sensing part of the sensor.

When the cassette is properly mounted in the main body, the second actuator may be held at a predetermined position due to interfering with the at least a portion of the cassette, causing the second sensing arm to be positioned away from the sensing part of the sensor.

The first sensing arm the second sensing arm may be arranged so as to contact each other, the first sensing arm comprising a first contact surface having a first shape, the second sensing arm comprising a second contact surface having a second shape corresponding with the first shape such that the first contact surface and the second contact surface contact each other without a substantial gap therebetween.

When the first sensing arm and the second sensing arm are in contact with each other, the first sensing arm may press the second sensing arm with a force larger than a pressing force of the second sensing arm on the first sensing arm.

The cassette may comprise a loading plate having at least one of a recess and a hole formed thereon, and the first operation arm may comprise a contact protrusion protruding from the first operation arm, the at least one of a recess and a hole being configured and arranged to receive the contact protrusion when no printing medium is present on the loading plate.

The main body may include therein a proper mounting location for the cassette, when the cassette is positioned at a predetermined distance from the proper mounting location in the main body, at least one of the first sensing arm and the second sensing arm is sensed by the sensor.

The first operation arm may be contacted with the printing medium loaded in the cassette, and at least one of the first sensing arm and the second sensing arm may be sensed by the sensor according to the number of printing media loaded in the cassette.

When the cassette is positioned at a predetermined distance from proper mounting location in the main body, the first sensing arm may be sensed by the sensor when the amount of the printing medium loaded in the cassette is equal to or less than a first predetermined reference value.

When the cassette is positioned at a predetermined distance from proper mounting location in the main body, the second sensing arm may be sensed by the sensor when the amount of the printing medium loaded in the cassette is equal to or more than a second predetermined reference value, the second predetermined value being larger than the first predetermined value.

When the amount of the printing medium loaded in the cassette is more than the first reference value and less than the second reference value, both the first sensing arm and the second sensing arm may be sensed by the sensor.

When the cassette is properly mounted in the main body, a part of the cassette may not be accommodated within the main body, and may protrude out of the main body.

In accordance with another aspect of the invention, there is provided a printing medium feeding unit of an image forming apparatus, the image forming apparatus including a main body including a cassette accommodating portion, in which a cassette for holding printing medium therein is removably accommodated, the printing medium feeding unit comprising: a first actuator configured to move in relation to a presence of the printing medium in the cassette; a second actuator configured to move in relation to a location of the cassette within the main body; and a sensor arranged to sense operational states of the first actuator and the second actuator, the sensor being configured to provide an indication of a normal operational condition, under which neither of a first abnormal condition and a second abnormal condition exists, the first abnormal condition being the cassette not being properly mounted in the main body, the second abnormal condition being the printing medium being absent in the cassette.

The first actuator may include a first pivot shaft, a first operation arm extending from a first end of the first pivot shaft toward the cassette accommodating portion, and a first sensing arm extending from a second end, opposite the first end, of the first pivot shaft toward the sensor, the first operation arm being configured to contact, and to move in relation to an amount of, the printing medium held in the cassette to cause the first pivot shaft to rotate, which in turn causes the first sensing arm to move into and out of a range of detection of the sensor, and the second actuator may include a second pivot shaft, a second operation arm extending from a first end of the second pivot shaft toward a position within the main body capable of interfering with the cassette, and a second sensing arm extending from a second end, opposite the first end, of the second pivot shaft toward the sensor, the second operation arm being configured to interfere with at least a portion of the cassette to move in relation to the location of the cassette in the main body to cause the second pivot shaft to rotate, which in turn causes the second sensing arm to move into and out of the range of detection of the sensor.

The first sensing arm and the second sensing arm may be arranged so as to contact each other, the first sensing arm comprising a first contact surface having a first shape, the second sensing arm comprising a second contact surface having a second shape corresponding with the first shape such that the first contact surface and the second contact surface contact each other without a substantial gap therebetween.

When no external force is applied to the first actuator, at least a part of the first sensing arm may be sensed by the sensor, and when no external force is applied to the second actuator, at least a part of the second sensing arm is sensed by the sensor.

When the cassette is properly mounted in the main body, the second actuator may be held at a predetermined position due to interfering with the at least a portion of the cassette, causing the second sensing arm to be positioned away from the sensor.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE PREFERRED EMBODIMENTS

Figure 1A:
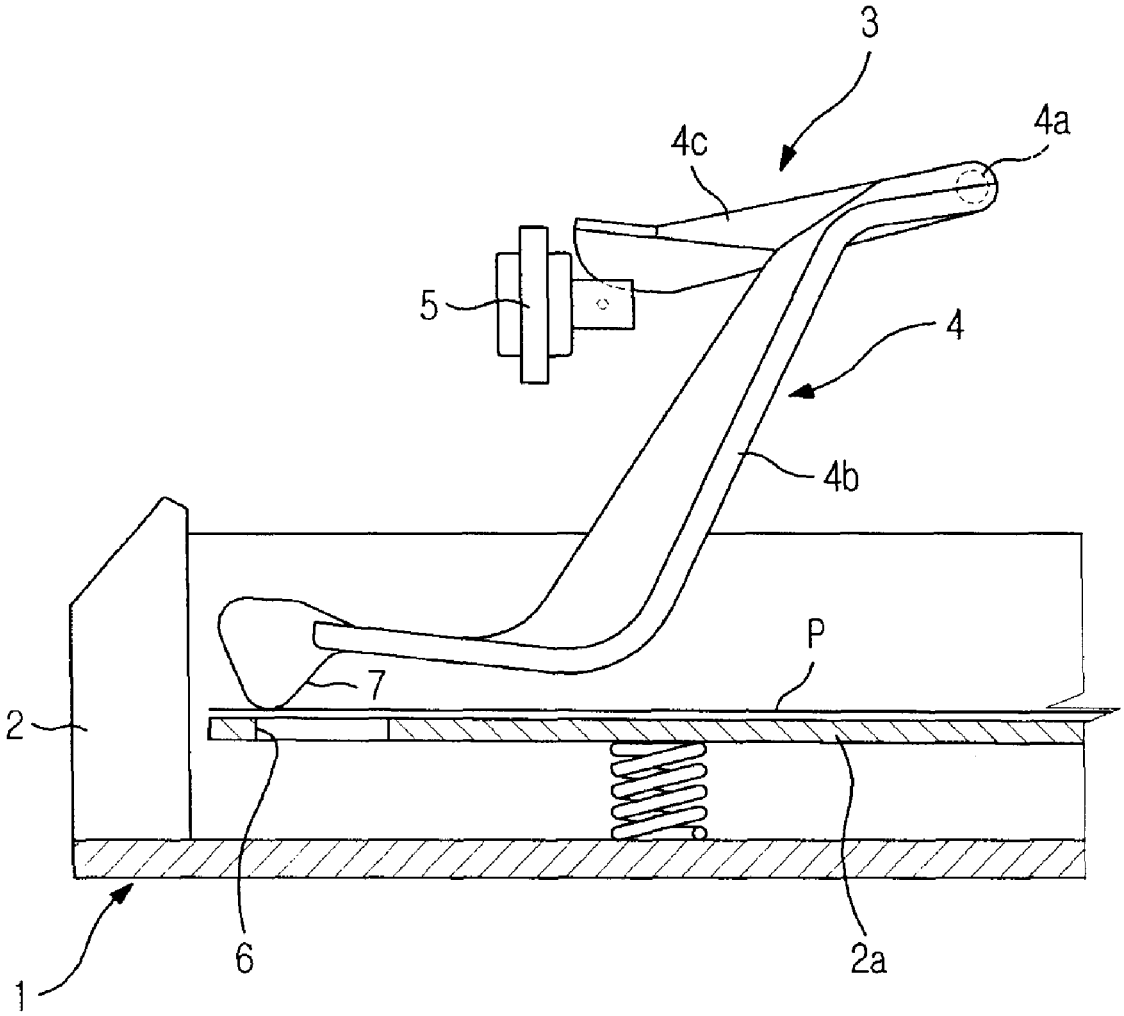
FIGS. 1*a* to 1*c* are views showing a conventional paper feeding unit having a paper sensing device.
Figure 1B:
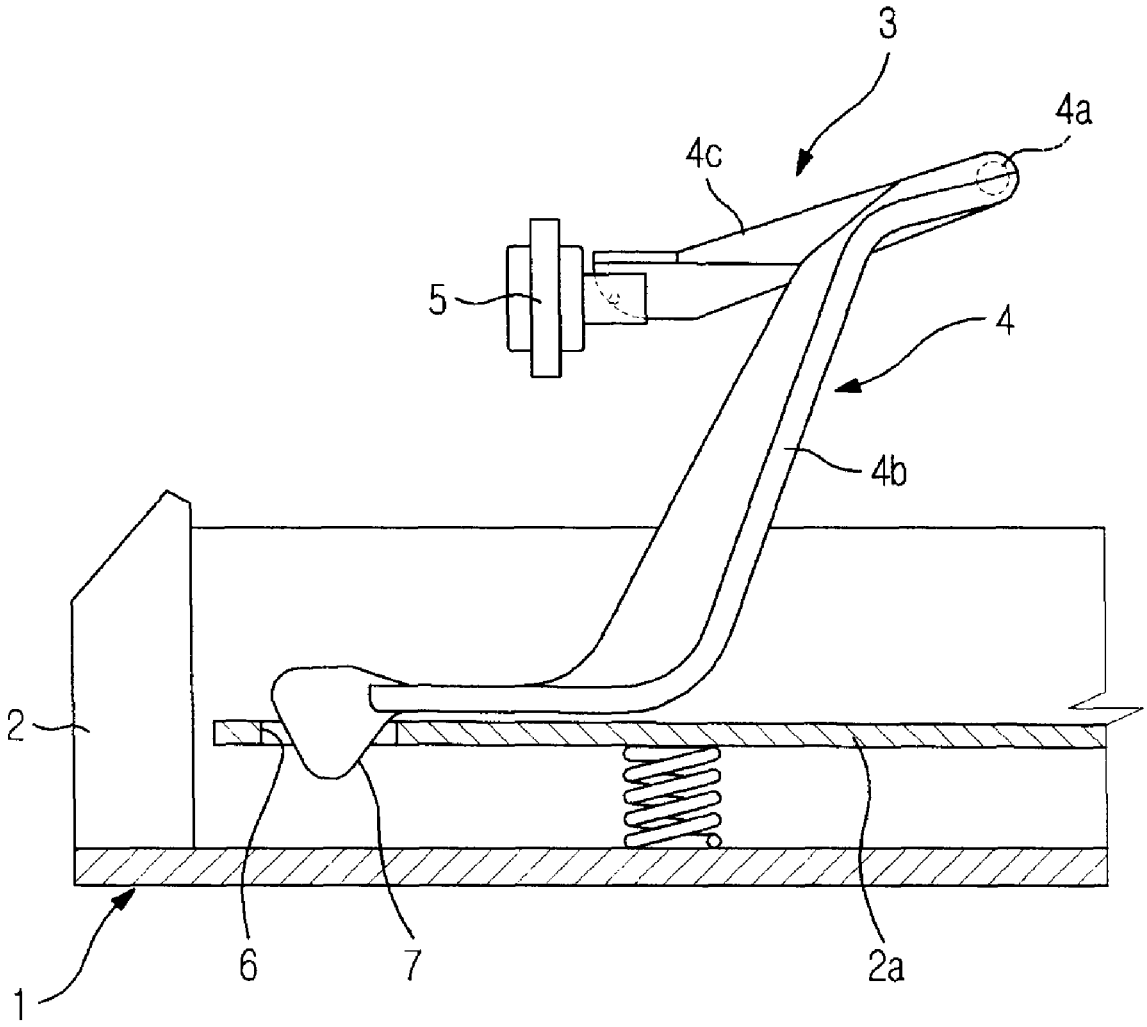
Figure 1C:
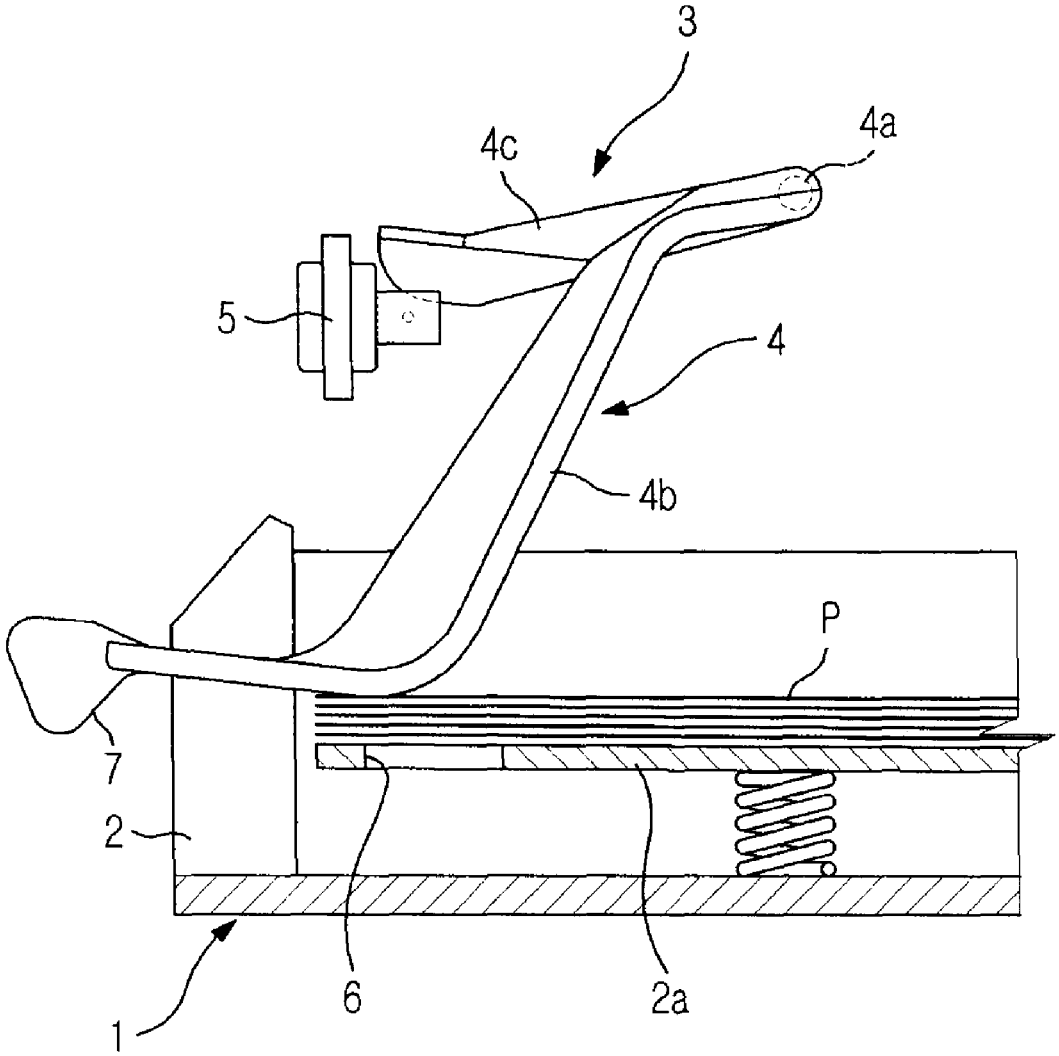

Reference will now be made in detail to embodiments of the present invention, examples of which are illustrated in the accompanying drawings, wherein like reference numerals refer to like elements throughout. The embodiments are described below to explain the present invention by referring to the figures.

Figure 2:
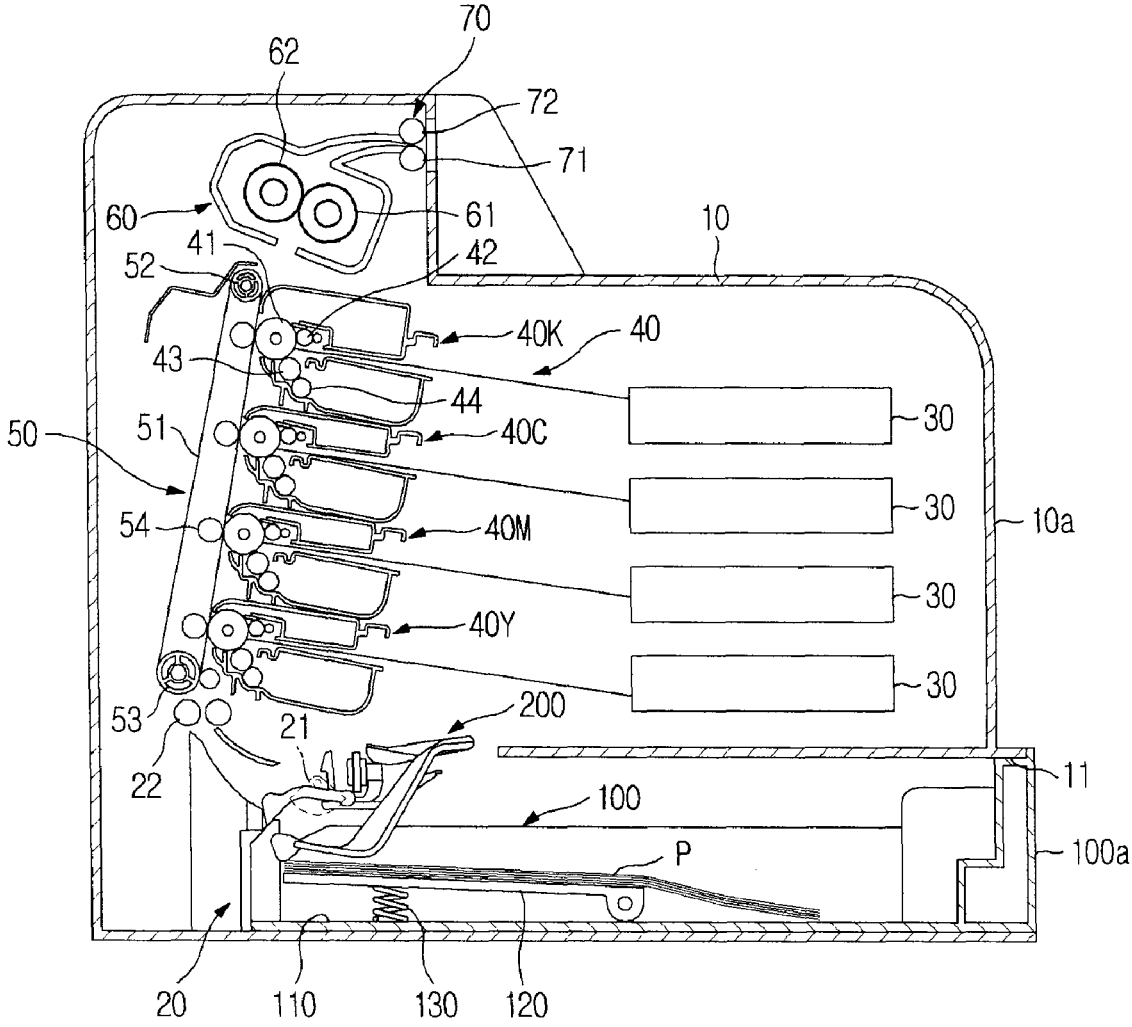
FIG. 2 is a view showing the relevant portions of an image forming apparatus according to an embodiment of the present invention.

As shown in FIG. 2, an image forming apparatus according to the present invention comprises a main body 10, a paper feeding unit 20, a laser scanning unit 30, a developing unit 40, a transfer unit 50, a fusing unit 60 and a paper discharge unit 70. The laser scanning unit 30, the developing unit 40, the transfer unit 50 and the fusing unit 60 may be considered as components of the image forming unit that forms an image on the paper. The components of the image forming unit are mounted in the main body 10.

The main body 10 forms an overall exterior appearance of the image forming apparatus, and supports the components mounted therein.

The paper feeding unit 20 includes a cassette 100 to store paper P therein, a pickup roller 21 to pick up the paper P stored in the cassette 100, e.g., one sheet at a time, and a feeding roller 22 to convey the picked-up paper toward the developing unit 40.

The cassette 100 is removably mounted in the main body 10. The main body 10 includes an opening 11 at the front lower surface thereof, through which the cassette 100 can be mounted in the main body 10. For compactness of the image forming apparatus, this embodiment is configured such that portions of the main body 10 may be formed to have a smaller form factor than the cassette 100. That is, the front surface 100*a* of the cassette 100 protrudes further from the front surface 10*a* of the main body 10. The opening 11 of the main body 10 is formed in front of the front surface 10*a* of the main body 10 so as to cover an upper portion of the cassette 100.

The paper feeding unit 20 includes a sensing unit 200 to sense whether the cassette 100 is properly mounted in the main body 10 and also whether the paper is present in the cassette 100. The sensing unit 200 achieves the above sensing operation using a single sensor. More detailed explanation of the sensing unit 200 will be made later.

In the embodiment shown in FIG. 2, the developing unit 40 includes four developing devices 40Y, 40M, 40C and 40K, in which toners of different colors, e.g., yellow (Y), magenta (M), cyan (C) and black (K) toners are respectively stored. The developing devices 40Y, 40M, 40C and 40K respectively have photosensitive body 41, on surfaces of which electrostatic latent images are formed by the laser scanning unit 30. The laser scanning unit 30 irradiates beams corresponding to image information of yellow, magenta, cyan and black onto the photosensitive bodies 41 of the developing devices according to a printing signal. While in this embodiment, four developing devices and four light scanning units are shown as an example of color image forming apparatus, it should be readily apparent to and understood by one of ordinary skill that other embodiments that has more or less number of developing devices and/or light scanning units. For example, a monochromatic image forming apparatus, i.e., which forms a black and while image, may only require only one of each of developing device and light scanning unit.

Each of the developing devices 40Y, 40M, 40C and 40K has a charge roller 42 to charge the photosensitive body 41, a developing roller 43 to develop the electrostatic latent image formed on the photosensitive body 41 into a toner image by supplying the toner to the electrostatic latent image, and a supply roller 44 to supply the toner to the developing roller 43.

The transfer unit 50 serves to transfer the toner images developed on the photosensitive bodies 41 onto the paper. The transfer unit 50 includes a transfer belt 51 circulating in contact with the photosensitive bodies 41, a driving roller 52 to drive the transfer belt 51, a tension roller 53 to keep tension of the transfer belt 51 constant, and four transfer rollers 54 to transfer the toner images developed on the photosensitive bodies 41 onto the paper.

The fusing unit 60 serves to fuse the toner images, transferred onto the paper by the transfer unit 50, to the paper. The fusing unit 60 may include a heating roller 61 having a heat source, and a press roller 62 mounted in close contact with the heating roller 61. While the paper passes between the heating roller 61 and the press roller 62, the toner images are fused to the paper by heat from the heating roller 61 and the pressure between the heating roller 61 and the press roller 62.

The paper discharge unit 70 serves to discharge the printed paper outside the image forming apparatus. The paper discharge unit 70 includes a discharge roller 71, and a discharge backup roller 72 mounted to oppose the discharge roller 71.

As shown in FIG. 2, the cassette 100 includes a cassette housing 110, a loading plate 120 hingedly mounted in the cassette housing 110, and a spring 130 to elastically support the loading plate 120.

One end portion of the loading plate 120 is hingedly coupled to the cassette housing 110, so that the other end portion of the loading plate 120 can be pivoted up and down within a predetermined range of angles. Although not illustrated in the drawings, a cam is mounted above the cassette 100 in the main body 10, to press down the loading plate 120 when the cassette 100 is mounted in the main body 10. If a part of the cam presses down the loading plate 120, the loading plate 120 is pivoted down. If the cam moves away from the loading plate 120, the loading plate 120 is pivoted up by the elastic force of the spring 130. During the paper supply operation, the cam rotates, and accordingly the loading plate 120 pivots up and down about the hinge part. When the loading plate 120 is in an upwardly-pivoted state, the paper loaded on the loading plate 120 is in contact with the pickup roller 21, and is picked up a sheet at a time.

Although not illustrated in the drawings, a locking device may be mounted to the cassette 100 to restrict the pivoting of the loading plate 120. When the cassette 100 is not properly mounted in the main body 10, the locking device restricts the loading plate 120, so that the loading plate 120 is in a down position. If the cassette 100 is properly mounted in the main body 10, the locking device releases the loading plate 120. Because such locking structure is already widely used, additional explanation thereof will be omitted.

Figure 3:
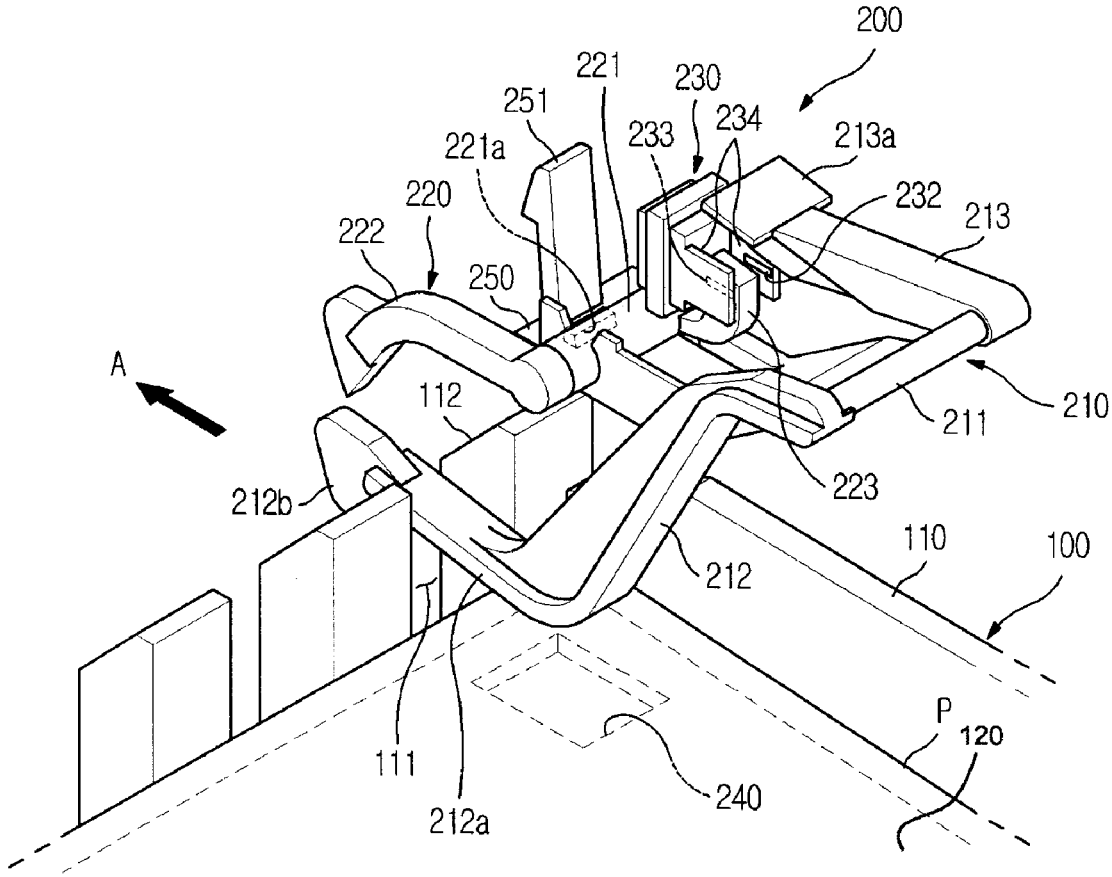
FIG. 3 is a perspective view showing the relevant portions of the cassette and the sensing unit usable with the image forming apparatus of FIG. 2.

FIG. 3 is a perspective view showing the cassette and the sensing unit of the image forming apparatus according to the present invention, and FIGS. 4 to 7 are views explaining operation of the sensing unit of the image forming apparatus according to the present invention. It is illustrated in FIG. 3 that a first actuator pivots to a predetermined angle by being in contact with the paper loaded in the cassette.

As shown in FIGS. 3 to 7, the sensing unit 200 includes a first actuator 210, a second actuator 220 and a sensor 230.

The sensor 230 senses the first actuator 210 and the second actuator 220, and transmits a sensed result to a control unit (not shown) of the image forming apparatus. If a sensing part 231 (refer to FIGS. 4 to 7) of the sensor 230 senses any one of the first actuator 210 and the second actuator 220, the control unit determines that the image forming apparatus is in an abnormal state, and prohibits the printing operation even if a print command may have been received.

The sensor 230 may be configured as an optical sensor having a light emitting part 232 and a light receiving part 233. The sensor 230 has two supporting members 234 opposing each other while interposing a predetermined space therebetween, and the light emitting part 232 and the light receiving part 233 are respectively mounted to the two supporting members 234. The sensing part 231 of the sensor 230 is defined in the space between the light emitting part 232 and the light receiving part 233. The sensing part 231 is conceptually illustrated in FIGS. 4 to 7.

The sensor 230 is not limited to the aforementioned optical sensor, and may be configured as other kinds of sensors capable of sensing the position of the first actuator 210 and the second actuator 220.

The first actuator 210 primarily serves to sense whether the paper is in the cassette 100. In addition, the first actuator 210 together with the second actuator 220 may also serve to sense whether the cassette 100 is properly mounted in the main body 10.

The first actuator 210 is pivotally mounted to a frame (not shown) provided in the main body 10. The first actuator 210 includes a pivot shaft 211, a first operation arm 212 extended toward the paper P loaded in the cassette 100 from one end portion of the pivot shaft 211, and a first sensing arm 213 extended toward the sensor 230 from the other end portion of the pivot shaft 211.

The first operation arm 212 has a printing medium contact part 212*a* which is extended in a direction of mounting the cassette 100 in the main body 10 (direction of arrow A). If the printing medium contact part 212*a* comes into contact with the paper P loaded on the loading plate 120, the first operation arm 212 pivots upward, and accordingly the first sensing arm 213 is also moves up (refer to FIGS. 5 and 6).

The printing medium contact part 212*a* is provided with a contact protrusion 212*b* at a front end thereof, which is protruded toward the loading plate 120. The loading plate 120 of the cassette is formed with an operation hole 240, in which the contact protrusion 212*b* can be received. When the empty cassette 100 is mounted in the main body 10 or the paper in the cassette is used up during the printing operation, the contact protrusion 212*b* is received in the operation hole 240, and accordingly the first sensing arm 213 pivots down to shield the sensing part 231 of the sensor 230 (refer to FIG. 7).

The first sensing arm 213 is provided with a latching part 213*a* extending both left and right from the top portion of an end of the first sensing arm 213. While no external force is applied, the first actuator 210 has a tendency to pivot downward by its own weight. However, the first sensing arm 213 is prevented from pivoting down further by the latching part 213*a* being supported by top surfaces of the two supporting members 234 of the sensor 230. In such a state, the end portion of the first sensing arm 213 shields the sensing part 231 of the sensor 230 (refer to FIG. 4).

The cassette housing 110 is formed with an opening 111 at a front end portion thereof, so as to avoid interference of the cassette housing 110 with the first actuator 210 when the cassette 100 is mounted and removed into/from the main body 10.

The second actuator 220 serves to sense whether the cassette 100 is properly mounted in the main body 10. The second actuator 220 includes a pivot shaft 221, a second operation arm 222 and a second sensing arm 223. The second actuator 220 is pivotally mounted to a fixing bracket 250, which is fixed to the frame (not shown) provided in the main body 10, through a hook part 251.

The pivot shaft 221 has a latching protrusion 221*a* protruded in a radial direction of the pivot shaft. If the latching protrusion 221*a* is latched to the bottom of the fixing bracket 250, the second operation arm 222 is prevented from pivoting down any further.

The second operation arm 222 is extended down toward the cassette 100 from one end portion of the pivot shaft 221, and the second sensing arm 223 is extended up toward the sensor 230 from the other end portion of the pivot shaft 221. The second operation arm 222 is formed to be heavier than the second sensing arm 223. While no external force is applied, the second operation arm 222 has a tendency to be pivoted down by its own weight, and thus the second sensing arm 223 has a tendency to be pivoted up. However, if the latching protrusion 221*a* of the pivot shaft 221 reaches the position of being supported by the bottom of the fixing bracket 250, the second sensing arm 223 does not pivot up any further. In such a state, the end portion of the second sensing arm 223 shields the sensing part 231 of the sensor 230 (refer to FIG. 5).

The end portion of the second operation arm 222 is placed at a position capable of interfering with the cassette 100 mounted in the main body 10. The front end portion of the cassette housing 110 is provided with an interfering part 112 which interferes with the second operation arm 222. If the second operation arm 222 interferes with the cassette 100, and is thus pivoted up, the second sensing arm 223 pivots down, and accordingly the second sensing arm 223 moves away from the sensing part 231 of the sensor 230 (refer to FIG. 6).

The second sensing arm 223 is disposed below the first sensing arm 213. The second sensing arm 223 comes in contact with the first sensing arm 213 when the first sensing arm 213 is within the pivot range of the second sensing arm 223. When the first sensing arm 213 and the second sensing arm 223 are in contact with each other, the position of the second sensing arm 223 is decided by the position of the first sensing arm 213. That is, while no external force is applied to the second actuator 220, the second sensing arm 223 has a tendency to be pivoted up by the weight of the second operation arm 222. However, when the second sensing arm 223 is in contact with the first sensing arm 213, a pressing force of the first sensing arm 213 on the second sensing arm 223 is larger than the pivoting force of the second sensing arm 223. Accordingly, the position of the second sensing arm 223 is decided by the position of the first sensing arm 213 (refer to FIGS. 4 and 7).

In most cases, either the first sensing arm 213 or the second sensing arm 223 is sensed by the sensing part 231 of the sensor 230. However, in some cases, both the first sensing arm 213 and the second sensing arm 223 may be positioned at the sensing part 231 of the sensor 230 at the same time.

Figure 8:
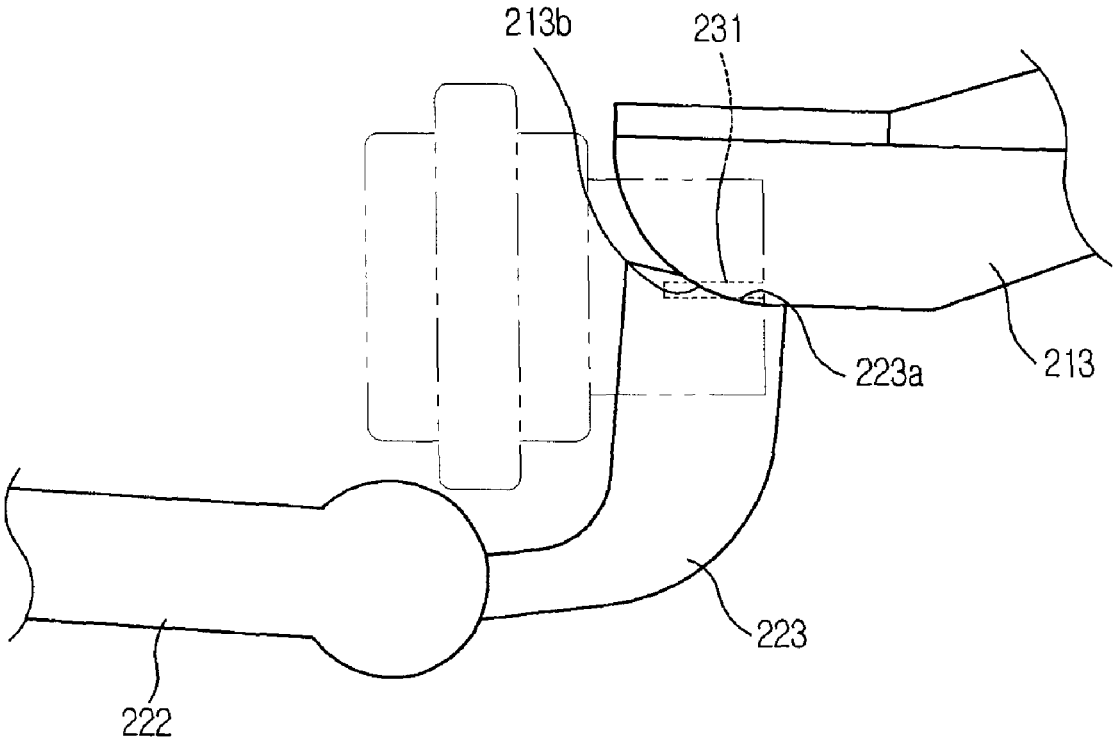
FIG. 8 is an enlarged view of the first sensing arm and the second sensing arm when the first sensing arm and the second sensing arm are positioned in the sensing part of the sensor at the same time.

FIG. 8 is an enlarged view showing the first sensing arm and the second sensing arm when the first sensing arm and the second sensing arm are positioned in the sensing part of the sensor at the same time. As shown in FIG. 8, when the first sensing arm 213 and the second sensing arm 223 are positioned in the sensing part 231 of the sensor at the same time, the first sensing arm 213 covers a portion of the sensing part 231, and the second sensing arm 223 covers the remaining portion of the sensing part 231. The reason for such a constitution is to prevent occurrence of a sensing error due to leakage of light through a gap between the first sensing arm 213 and the second sensing arm 223 when the first sensing arm 213 and the second sensing arm 223 are positioned at the sensing part 231 at the same time while being contacted with each other.

To achieve this, in an embodiment, the lower surface of the first sensing arm 213, which comes in contact with the second sensing arm 223, may be provided with a first inclined portion 213*b*. The upper surface of the second sensing arm 223, which comes in contact with the first sensing arm 213, may also be provided with a second inclined portion 223*a*, which corresponds to the first inclined portion 213*b* of the first sensing arm 213.

A reference numeral 12 in FIGS. 4 to 7 denotes a paper feeding guide mounted in the main body 10. The paper feeding guide 12 serves to guide the paper, which is picked up by the pickup roller 21 during the printing operation, toward the developing unit 40.

Figure 4:
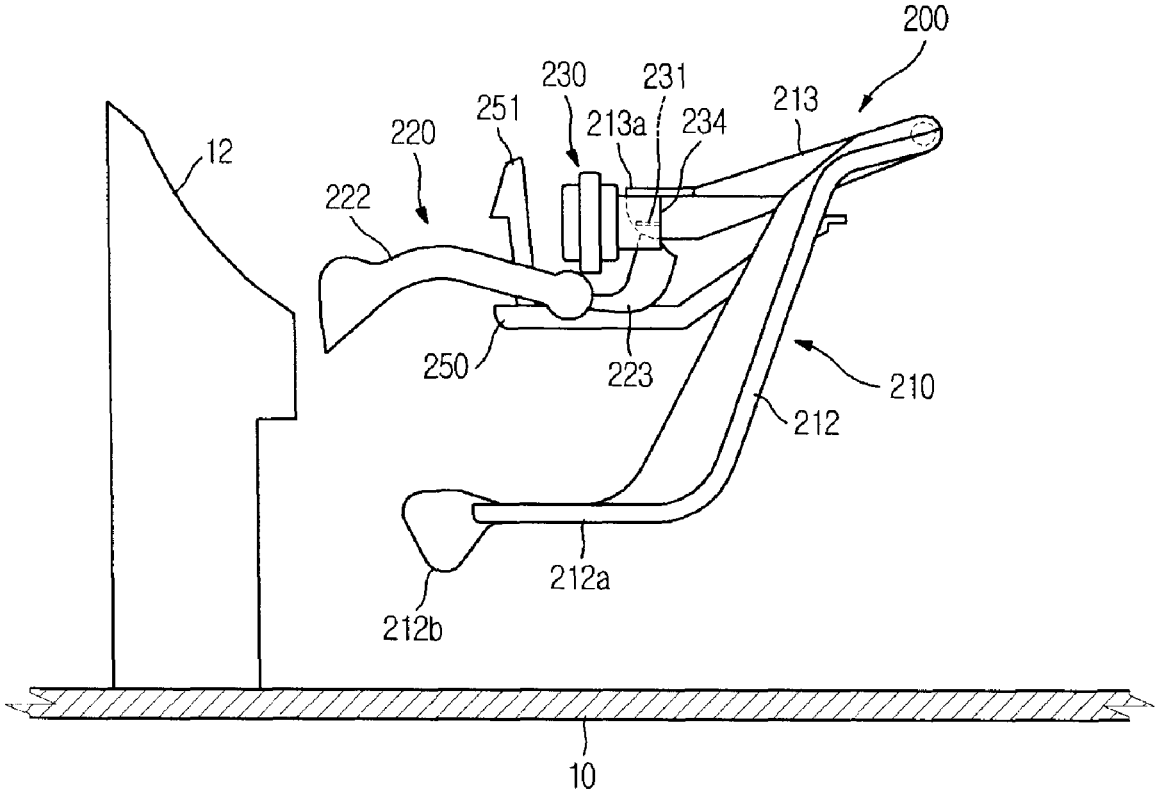
FIGS. 4 to 7 are views explaining operation of the sensing unit of FIG. 3.
Figure 5:
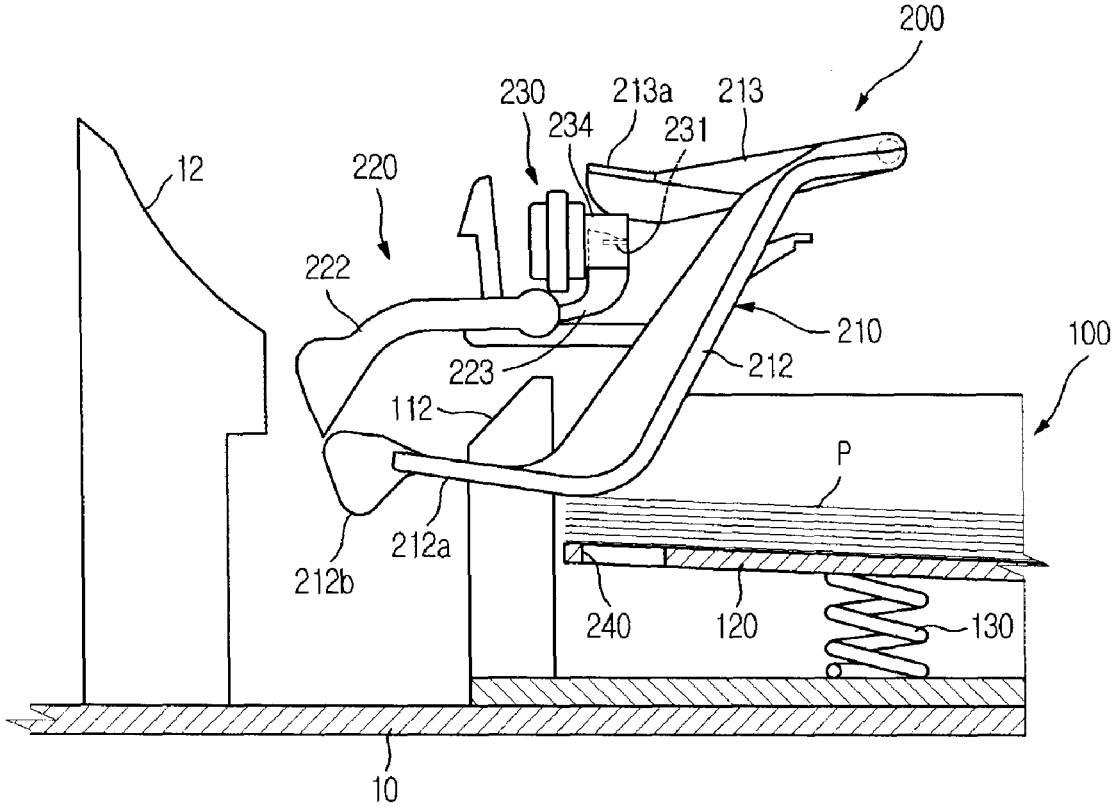
Figure 6:
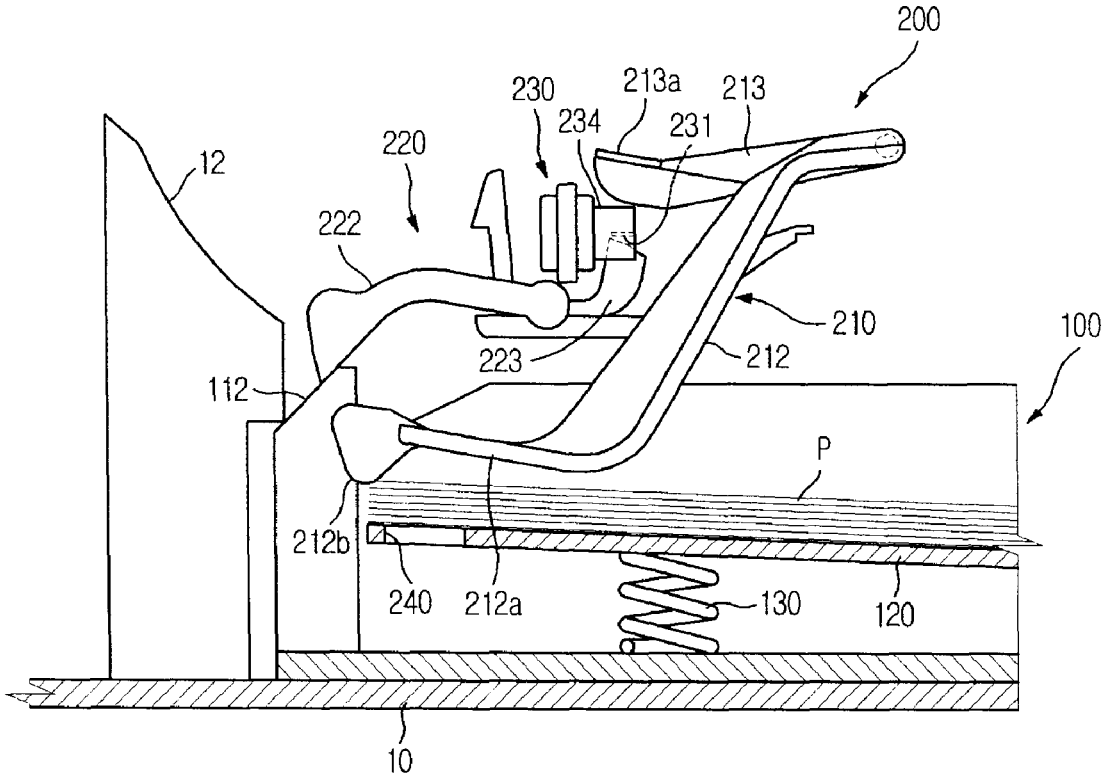
Figure 7:
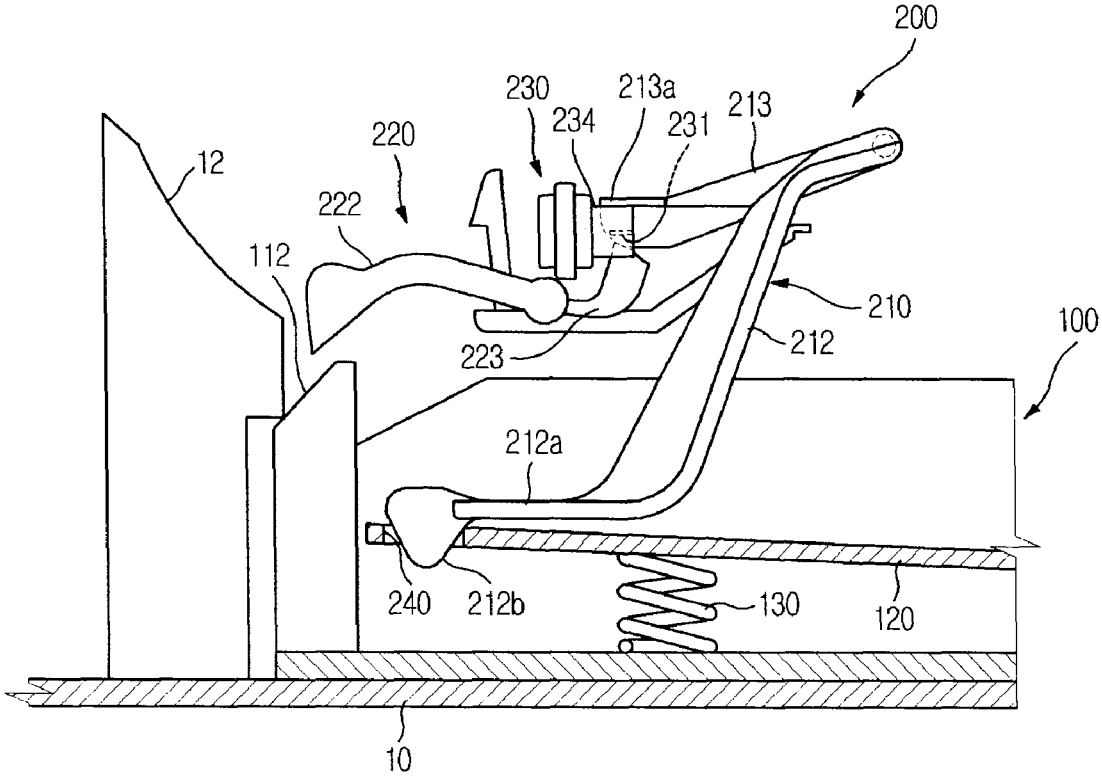

Hereinafter, the operation of the sensing unit will be described with reference to FIGS. 4 to 7. FIG. 4 shows a state in which the cassette 100 is absent in the main body 10, and FIG. 5 shows a state in which a rear end portion of the printing medium contact part 212*a* is contacted with the paper P in the process of mounting the cassette 100 into the main body 10. FIG. 6 shows a state in which the cassette 100 is properly mounted in the main body 10, and the FIG. 7 shows a state in which the paper is not in the cassette 100.

As shown in FIG. 4, while the cassette 100 is not mounted in the main body 10, the first actuator 210 is in a downwardly-pivoted state by its own weight. The first sensing arm 213 shields the sensing part 231 of the sensor 230 while being supported by the supporting members 234 of the sensor 230. At this time, the second sensing arm 223 of the second actuator 220 is in a downwardly-pivoted state by being pushed by the first sensing arm 213. As such, when the cassette 100 is not mounted in the main body 10, the first sensing arm 213 is sensed by the sensor 230. When the first sensing arm 213 is sensed, the sensor 230 may produce a sensed signal, and may send the sensed signal to, or otherwise make the signal available for monitoring by, the control unit of the image forming apparatus. Accordingly, the control unit determines that the image forming apparatus is in a state incapable of normally achieving the printing operation.

As shown in FIG. 5, when the cassette 100 is partially mounted in the main body 10 and the rear end portion of the printing medium contact part 212*a* of the first operation arm 212 is contacted with the paper P, the first operation arm 212 pivots upward. The first sensing arm 213 also pivots up, and the first sensing arm 213 moves away from the sensing part 231 of the sensor 230. If the first sensing arm 213 pivots up, the second sensing arm 223 becomes free to pivot. Therefore, the second sensing arm 223 pivots up to shield the sensing part 231 of the sensor 230. Accordingly, the control unit determines that the image forming apparatus is in a state incapable of normally achieving the printing operation.

As described above, even when the cassette 100 is partially mounted in the main body 10 and the first sensing arm 213 is not sensed by the sensor 230, the second sensing arm 223 is sensed by the sensor 230. Therefore, the image forming apparatus according to the present invention can prevent a printing error of that the printing operation might be performed in an incompletely or improperly mounted state of the cassette 100 in the main body 10.

As shown in FIG. 6, if the cassette 100 is properly mounted in the main body 10, the end portion of the second operation arm 222 interferes with the front end portion of the cassette housing 110, and accordingly the second operation arm 222 is pivoted up. The second sensing arm 223 is pivoted down and moves away from the sensing part 231 of the sensor 230. In such a state, the front end of the printing medium contact part 212*a* is contacted with the paper P loaded on the loading plate 120. The first operation arm 212 is pivoted up by the paper P, and accordingly the first sensing arm 213 also pivots up and moves away from the sensing part 231 of the sensor 230.

As such, if both the first sensing arm 213 and the second sensing arm 223 move away from the sensing part 231 of the sensor 230, light emitted from the light emitting part of the sensor 230 is transmitted to the light receiving part. The control unit determines that the cassette is properly mounted in the main body and the paper is loaded in the cassette, and makes the image forming apparatus perform the printing operation according to, e.g., a print command.

As shown in FIG. 7, when the paper is not in the cassette 100 because a user mounts an empty cassette in the main body or the paper is used up during the printing operations, the contact protrusion 212*b* formed at the front end of the printing medium contact part 212*a* is received in the operation hole 240 of the loading plate 120. The first operation arm 212 and the first sensing arm 213 are pivoted down by their own weights, and thus the first sensing arm 213 shields the sensing part 231 of the sensor 230. Accordingly, the control unit determines that the image forming apparatus is in a state incapable of normally achieving the printing operation.

Figure 9:
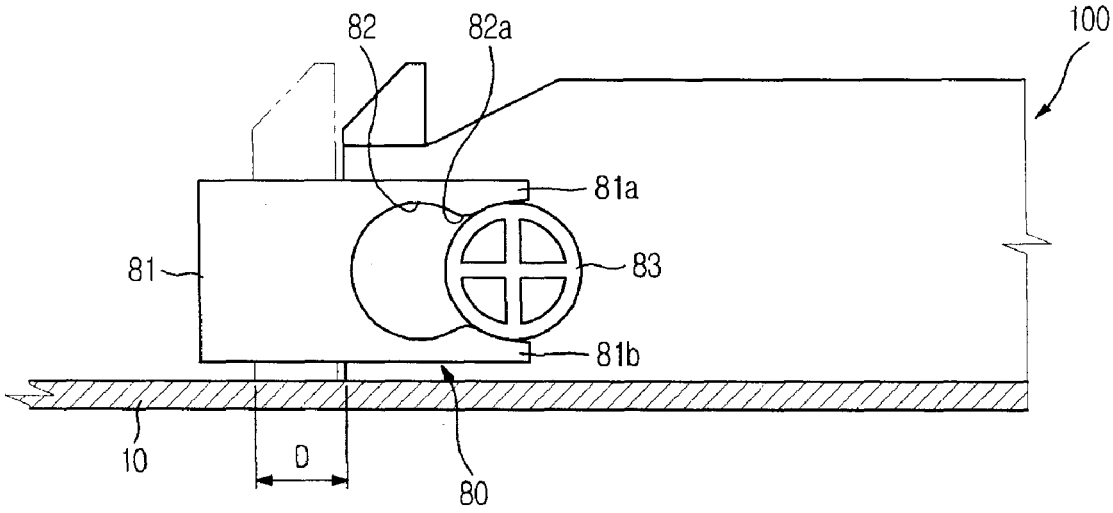
FIG. 9 is a view showing a cassette fixing device of an image forming apparatus according to an embodiment of the present invention.

FIG. 9 is a view showing a cassette fixing device of the image forming apparatus according to an embodiment. As shown in FIG. 9, the image forming apparatus may further comprise a cassette fixing device 80 to prevent movement of the cassette 100 when the cassette 100 is mounted in the main body 10.

The cassette fixing device 80 includes a fixing member 81 mounted in the main body 10, and a fixing protrusion 83 formed at a side surface of the cassette housing 110. The fixing member 81 has a fixing recess 82, in which the fixing protrusion 83 is received. An inlet 82*a* of the fixing recess 82 is formed smaller than a diameter of the fixing protrusion 83. If a user pushes the cassette 100 beyond the position at a predetermined distance D from the properly mounted position as shown in FIG. 9, portions 81*a* and 81*b* defining the inlet of the fixing member 81 are elastically deformed, so that the fixing protrusion 83 can move into the fixing recess 82, and become secured therein.

As described above, in order to properly mount the cassette 100 in the main body 10, the user must further push the cassette 100 into the main body 10 from the state shown in FIG. 9. However, the user often does not push the cassette 100 in the main body 10 beyond the position shown in FIG. 9 because he/she mistakes the state of FIG. 9 for the properly mounted state of the cassette 100 in the main body 10. By the sensing unit 200 of the present invention, also when the cassette 100 is positioned at the predetermined distance D from the proper mounting position, it can be determined that the cassette 100 is not properly mounted in the main body 10.

Figure 10:
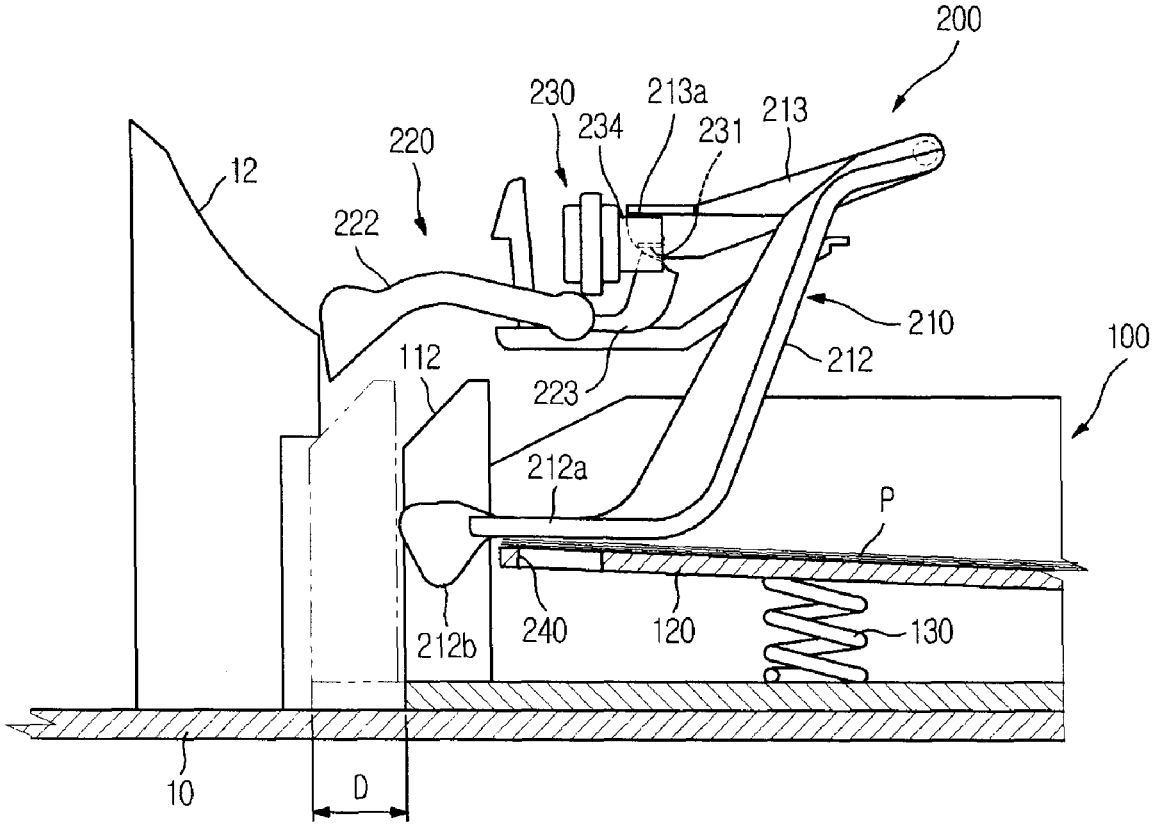
FIGS. 10 to 12 are views explaining operation of the sensing unit when the cassette is positioned at a predetermined distance D from the proper mounting position.
Figure 11:
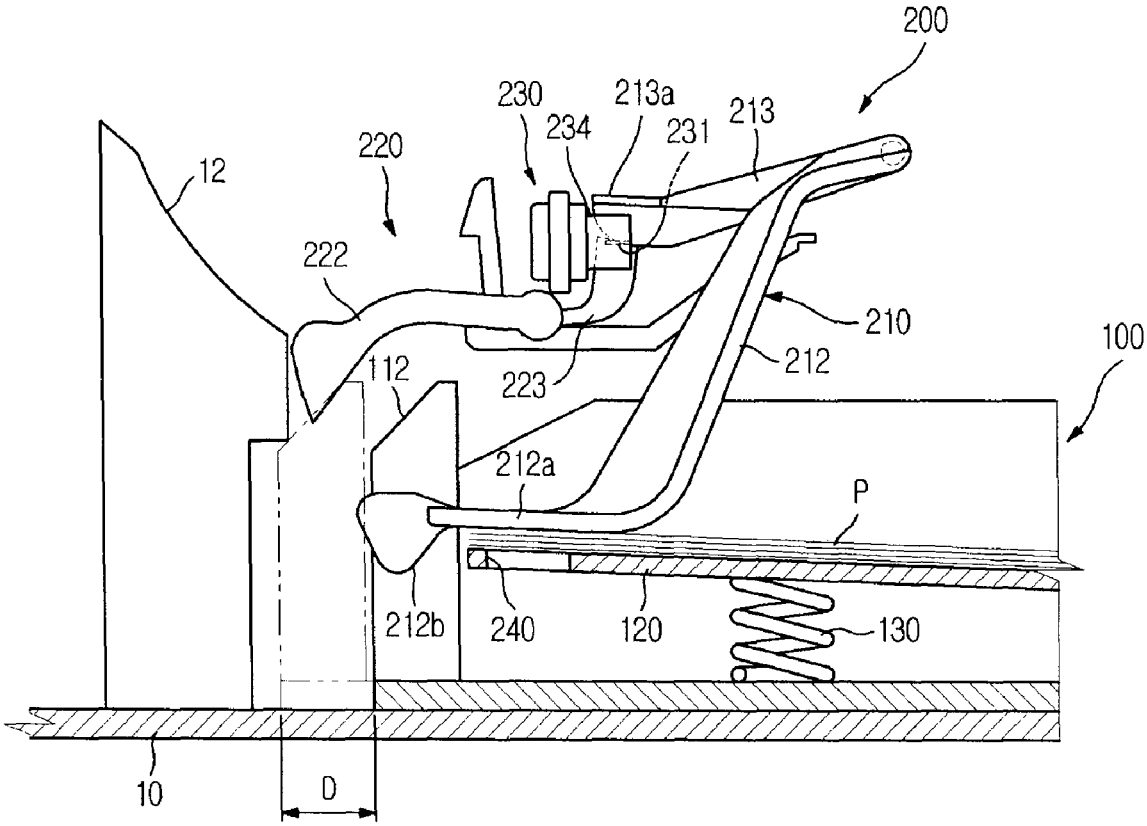
Figure 12:
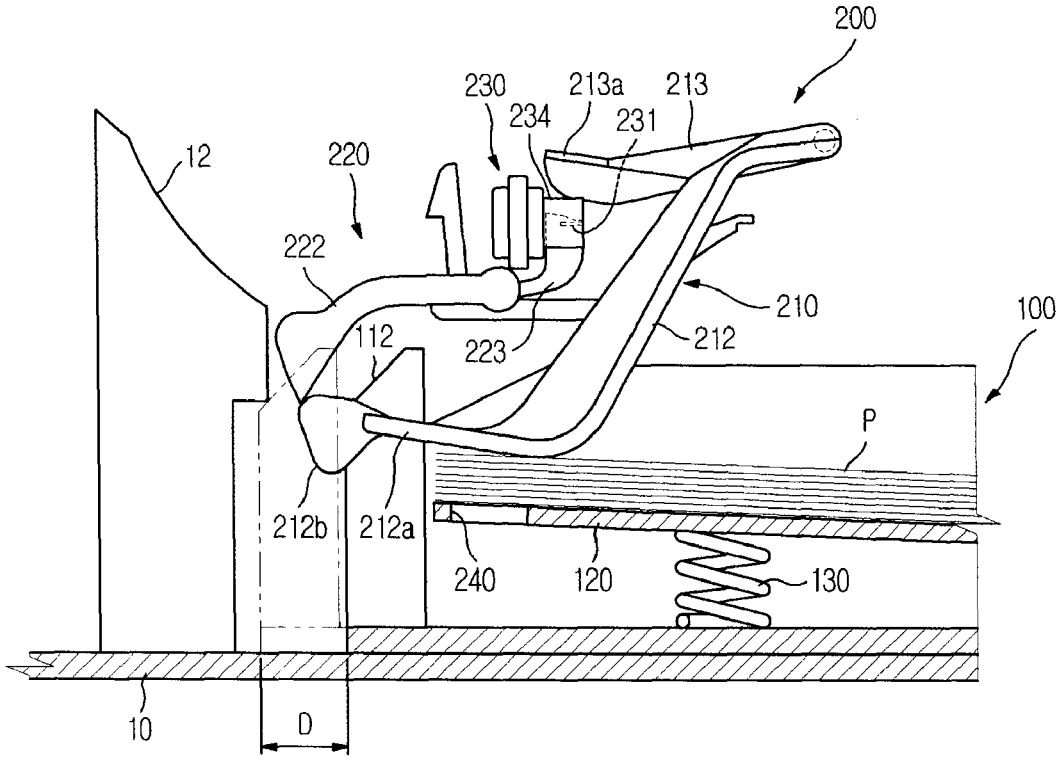

FIGS. 10 to 12 are views explaining the operation of the sensing unit when the cassette is positioned at the predetermined distance D from the proper mounting position.

As shown in FIG. 10, when the number of sheets of paper loaded on the loading plate 120 is equal to or less than a first reference value S1 (for example, when the number of paper sheets is 5 or less), the degree of pivot of the first operation arm 212 from the contact with the paper P is small. Thus, although the first sensing arm 213 may pivot up with the first operation arm 212, the first sensing arm 213 does not completely move out of the sensing part 231 of the sensor 230. Accordingly, the first sensing arm 213 is sensed by the sensor 230. As a result, the control unit determines that the image forming apparatus is in a state incapable of normally achieving the printing operation.

As shown in FIG. 11, when the number of paper sheets loaded on the loading plate 120 is more than the first reference value S1 and less than a second reference value S2 (for example, when the number of paper sheets is between 6 and 29), the degree of pivot of the first operation arm 212 by contact with the paper P is larger than the pivoting degree shown in FIG. 10. The first sensing arm 213 covers a portion of the sensing part 231 of the sensor 230, and the second sensing arm 223 pivots up to cover the remaining portion of the sensing part 231. Accordingly, both the first sensing arm 213 and the second sensing arm 223 are sensed by the sensor 230 at the same time. As a result, the control unit determines that the image forming apparatus is in a state incapable of normally achieving the printing operation.

As shown in FIG. 12, when the number of sheets of paper loaded on the loading plate 120 is equal to or more than the second reference value S2 (for example, when the number of sheets is 30 or more), the first operation arm 212 is pivoted up by contact with the paper P, so that the first sensing arm 213 moves away from the sensing part 231 of the sensor 230. Thereby, the second sensing arm 223 released from the first sensing arm 213 is pivoted up and shields the sensing part 231 of the sensor 230. As a result, the control unit determines that the image forming apparatus is in a state incapable of normally achieving the printing operation.

As apparent from the above description, the image forming apparatus above described can determine whether the cassette is properly mounted in the main body and whether the paper is in the cassette, by use of a single sensor. That is, the sensor 230 of the embodiments described above is capable of indicating, at least with respect to the two possible abnormal conditions, namely, the cassette not being properly mounted and the cassette being empty (i.e., no paper is present in the cassette), a normal operational condition, under which neither of the two specific abnormal conditions exists. For example, the sensor 230 can be made to produce an output signal indicative of the normal operational condition, i.e., when neither of the first and second sensor arms 213 and 223 are detected by the sensing part 231. In the alternative, the sensor 230 may produce an output signal only when at least one of the first and second sensor arms 213 and 223 are detected by the sensing part 231, or, as even yet another alternative, the sensor 230 may produce output signal that varies in the signal level depending on the detected condition. In any case, based on the signal (or the absence thereof) of the sensor 230, it is possible to discern when neither of the above stated two specific abnormal conditions exists. It should be understood that it is not ultimately necessary to discern which one of the two abnormal conditions has caused the sensor 230 to indicate an abnormal operational condition.

Accordingly, the above described embodiments does not require a complicated internal structure of the image forming apparatus that necessitates a dedicated sensing device to sense whether the cassette is properly mounted in the main body, and thus can also reduce the manufacturing costs.

Further, the present invention can prevent occurrence of an operational error, such as jam, which might be caused by performing the printing operation while the cassette is not properly mounted in the main body.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a main body having housed therein an image forming unit;

a cassette removably mountable in the main body to hold printing medium therein; and a sensing unit provided in the main body to sense whether the cassette is mounted in the main body and whether the printing medium is present in the cassette, wherein the sensing unit comprises:

a sensor arranged to sense an occurrence of at least one of a first abnormal condition and a second abnormal condition, the first abnormal condition being the cassette not being properly mounted in the main body, the second abnormal condition being the printing medium being absent in the cassette, and the sensor providing an indication of a normal operational condition, under which neither of the first abnormal condition and the second abnormal condition exists.

2. The image forming apparatus according to claim 1, wherein the sensing unit further comprises:

a first actuator mounted in the main body, the first actuator being configured to operate in relation to a presence of the printing medium in the cassette; and a second actuator mounted in the main body, the second actuator being configured to operate in relation to a location of the cassette in the main body, wherein the sensor comprises a sensing part to sense operational states of the first actuator and the second actuator.

3. The image forming apparatus according to claim 2, wherein the first actuator includes a first pivot shaft, a first operation arm extending from a first end of the first pivot shaft toward the cassette, and a first sensing arm extending from a second end, opposite the first end, of the first pivot shaft toward the sensing part, the first operation arm being configured to contact, and to move in relation to an amount of, the printing medium held in the cassette to cause the first pivot shaft to rotate, which in turn causes the first sensing arm to move into and out of a range of detection of the sensing part of the sensor.

4. The image forming apparatus according to claim 3, wherein the second actuator includes a second pivot shaft, a second operation arm extending from a first end of the second pivot shaft toward a position within the main body capable of interfering with the cassette, and a second sensing arm extending from a second end, opposite the first end, of the second pivot shaft toward the sensing part, the second operation arm being configured to interfere with at least a portion of the cassette to move in relation to the location of the cassette in the main body to cause the second pivot shaft to rotate, which in turn causes the second sensing arm to move into and out of the range of detection of the sensing part of the sensor.

5. The image forming apparatus according to claim 4, wherein:

when no external force is applied to the first actuator, at least a part of the first sensing arm is sensed by the sensing part of the sensor, and when no external force is applied to the second actuator, at least a part of the second sensing arm is sensed by the sensing part of the sensor.

6. The image forming apparatus according to claim 4, wherein the sensor provides the indication of the normal operational condition only when both the first sensing arm and the second sensing arm are positioned away from the sensing part of the sensor.

7. The image forming apparatus according to claim 4, wherein when the cassette is properly mounted in the main body, the second actuator is held at a predetermined position due to interfering with the at least a portion of the cassette, causing the second sensing arm to be positioned away from the sensing part of the sensor.

8. The image forming apparatus according to claim 4, wherein the first sensing arm and the second sensing arm are arranged so as to contact each other, the first sensing arm comprising a first contact surface having a first shape, the second sensing arm comprising a second contact surface having a second shape corresponding with the first shape such that the first contact surface and the second contact surface contact each other without a substantial gap therebetween.

9. The image forming apparatus according to claim 8, wherein when the first sensing arm and the second sensing arm contact each other, the first sensing arm presses the second sensing arm with a force larger than a pressing force of the second sensing arm on the first sensing arm.

10. The image forming apparatus according to claim 4, wherein:

the main body includes therein a proper mounting location for the cassette, when the cassette is positioned at a predetermined distance from the proper mounting location in the main body, at least one of the first sensing arm and the second sensing arm is sensed by the sensor.

11. The image forming apparatus according to claim 10, wherein when the cassette is positioned at a predetermined distance from proper mounting location in the main body, the first sensing arm is sensed by the sensor when the amount of the printing medium loaded in the cassette is equal to or less than a first predetermined reference value,.

12. The image forming apparatus according to claim 11, wherein when the cassette is positioned at a predetermined distance from proper mounting location in the main body, the second sensing arm is sensed by the sensor when the amount of the printing medium loaded in the cassette is equal to or more than a second predetermined reference value, the second predetermined value being larger than the first predetermined value.

13. The image forming apparatus according to claim 12, wherein when the amount of the printing medium loaded in the cassette is more than the first reference value and less than the second reference value, both the first sensing arm and the second sensing arm are sensed by the sensor.

14. The image forming apparatus according to claim 3, wherein:

the cassette comprises a loading plate having at least one of a recess and a hole formed thereon, and the first operation arm comprises a contact protrusion protruding from the first operation arm, the at least one of a recess and a hole being configured and arranged to receive the contact protrusion when no printing medium is present on the loading plate.

15. The image forming apparatus according to claim 1, wherein when the cassette is properly mounted in the main body, a part of the cassette is not accommodated within the main body, and protrudes out of the main body.

16. A printing medium feeding unit of an image forming apparatus, the image forming apparatus including a main body including a cassette accommodating portion, in which a cassette for holding printing medium therein is removably accommodated, the printing medium feeding unit comprising:

a first actuator configured to move in relation to a presence of the printing medium in the cassette;

a second actuator configured to move in relation to a location of the cassette within the main body; and a sensor arranged to sense operational states of the first actuator and the second actuator, the sensor being configured to provide an indication of a normal operational condition, under which neither of a first abnormal condition and a second abnormal condition exists, the first abnormal condition being the cassette not being properly mounted in the main body, the second abnormal condition being the printing medium being absent in the cassette.

17. The printing medium feeding unit according to claim 16, wherein:

the first actuator includes a first pivot shaft, a first operation arm extending from a first end of the first pivot shaft toward the cassette accommodating portion, and a first sensing arm extending from a second end, opposite the first end, of the first pivot shaft toward the sensor, the first operation arm being configured to contact, and to move in relation to an amount of, the printing medium held in the cassette to cause the first pivot shaft to rotate, which in turn causes the first sensing arm to move into and out of a range of detection of the sensor, and the second actuator includes a second pivot shaft, a second operation arm extending from a first end of the second pivot shaft toward a position within the main body capable of interfering with the cassette, and a second sensing arm extending from a second end, opposite the first end, of the second pivot shaft toward the sensor, the second operation arm being configured to interfere with at least a portion of the cassette to move in relation to the location of the cassette in the main body to cause the second pivot shaft to rotate, which in turn causes the second sensing arm to move into and out of the range of detection of the sensor.

18. A printing medium feeding unit of an image forming apparatus, the image forming apparatus including a main body including a cassette accommodating portion, in which a cassette for holding printing medium therein is removably accommodated, the printing medium feeding unit comprising:

a sensor having a sensing part;

a first actuator having a first sensing arm and a first operation arm, the first sensing arm moving between a first position located in the sensing part and a second position spaced away from the sensing part, the first operation arm being in contact with the printing medium stored in the cassette; and a second actuator having a second sensing arm and a second operation arm, the second sensing arm moving between a third position located in the sensing part and a fourth position spaced away from the sensing part, the second operation arm being configured to-to interfere with the cassette.

19. The printing medium feeding unit according to claim 18, wherein the first actuator and the second actuator interlock with each other.

20. The printing medium feeding unit according to claim 18 wherein the first sensing arm and the second sensing arm are selectively positioned at the sensing part according to relative positions of the first actuator and the second actuator.

21. The printing medium feeding unit according to claim 18, wherein the first sensing arm and the second sensing arm are positioned at the sensing part at the same time while being contacted with each other according to relative positions of the first actuator and the second actuator.

* * * * *

UNITED STATES PATENT AND TRADEMARK OFFICE

CERTIFICATE OF CORRECTION

PATENT NO. : 8,070,153 B2
APPLICATION NO. : 12/142170
DATED : December 6, 2011
INVENTOR(S) : Kang It is certified that error appears in the above-identified patent and that said Letters Patent is hereby corrected as shown below:

Column 13, Line 62, In Claim 11, delete "value,." and insert -- value. --, therefor.

Column 15, Line 14, In Claim 18, delete "to-to" and insert -- to --, therefor.

Signed and Sealed this
Twenty-ninth Day of May, 2012

David J. Kappos

David J. Kappos
*Director of the United States Patent and Trademark Office*